United States Patent [19]

Becker et al.

[11] 4,148,179

[45] Apr. 10, 1979

[54] METHOD AND APPARATUS FOR YARN TREATMENT

[75] Inventors: Tilo Becker, Wiesloch; Hermann Storck, Bad Schonborn, both of Fed. Rep. of Germany; Terence A. Dyer, Harrogate, England

[73] Assignee: Imperial Chemical Industries Limited, London, England

[21] Appl. No.: 856,508

[22] Filed: Dec. 1, 1977

[30] Foreign Application Priority Data

Dec. 1, 1976 [GB] United Kingdom ..... 50086/76

[51] Int. Cl.[2] ..... D02J 1/08; D02J 13/00

[52] U.S. Cl. ..... 57/350; 28/271

[58] Field of Search ..... 57/34 HS, 77.3, 157 TS, 57/34 B, 157 F, 157 R; 28/247, 271, 274, 276

[56] References Cited

U.S. PATENT DOCUMENTS

| | | | |
|---|---|---|---|
| 2,515,299 | 7/1950 | Foster et al. | 57/77.3 |
| 3,206,922 | 9/1965 | Nagahara et al. | 57/77.3 |
| 3,279,164 | 10/1966 | Breen et al. | 57/77.3 X |
| 3,353,344 | 11/1967 | Clendening | 57/77.3 X |
| 3,490,219 | 1/1970 | Ozowa et al. | 57/77.3 X |
| 3,501,819 | 3/1970 | Satterwhite | 28/271 X |
| 3,583,140 | 6/1971 | Lorenz et al. | 57/77.3 X |
| 3,623,195 | 11/1971 | Nechvatal et al. | 57/34 B X |
| 3,714,686 | 2/1971 | Schmid et al. | 28/273 |
| 3,824,776 | 7/1974 | London | 57/34 B X |

*Primary Examiner*—Donald Watkins

*Attorney, Agent, or Firm*—Cushman, Darby & Cushman

[57] ABSTRACT

A process and apparatus for modifying the properties of a bulked yarn in which the bulked yarn is passed through a conduit and is subjected therein to twisting by fluid and at least one cycle of softening the yarn by heated fluid and cooling by fluid.

13 Claims, 9 Drawing Figures

Figure 1:
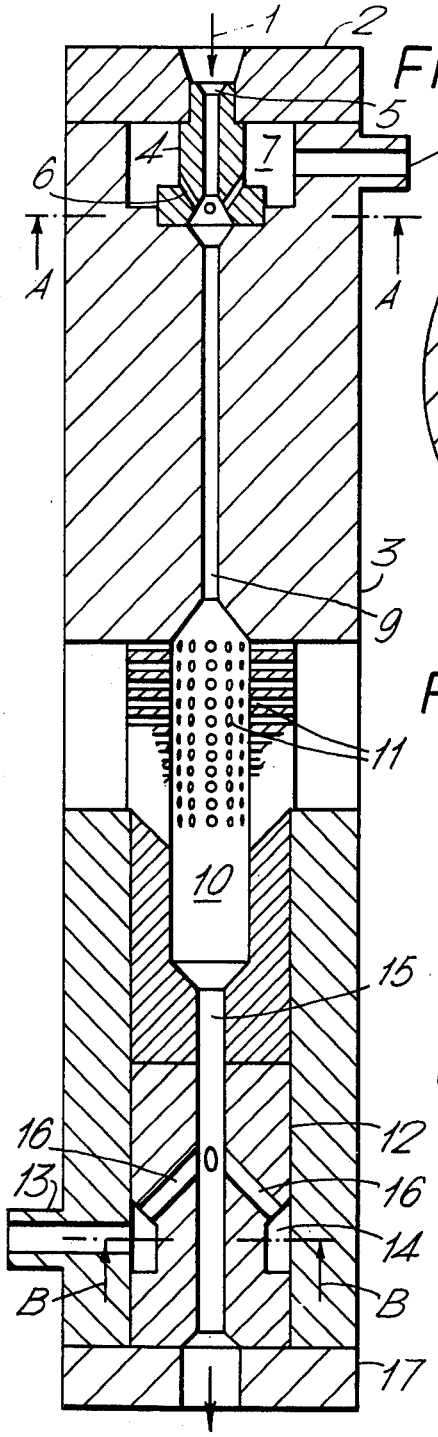

21
C
26
24
25
23
27
30
29
28
D
32
31
D
34
33
35
20
37
36
E
39
38
22

25
23
26
26
26
27
26

33
32
31
32

38
39
39

METHOD AND APPARATUS FOR YARN TREATMENT

The present invention relates to a process and apparatus for modifying the properties of a bulked yarn by fluid treatment.

According to the present invention, there is provided a continuous process for modifying the properties of a bulked yarn in which the bulked yarn is passed through a conduit and is subjected therein to (a) twisting by fluid and (b) at least one cycle of softening the yarn by heated fluid and cooling by fluid.

The invention also provides an apparatus for modifying the properties of a bulked yarn comprising a conduit having at least two longitudinally-spaced jet arrangements.

(a) at least one jet arrangement having means to direct fluid into the conduit such as to exert a twisting action on a yarn in the conduit and (b) at least one jet arrangement having means to direct heated fluid into the conduit for heating the yarn and (c) at least one jet arrangement having means to direct fluid into the conduit to cool the yarn.

The present invention may be applied to previously bulked yarn or a bulking stage and a subsequent modification stage according to the present invention may be combined in a continuous process.

The cross-sectional area of the conduit may be uniform or non-uniform along its length.

Each jet arrangement comprises at least one, preferably four, discrete channels to direct fluid into the conduit. When there are two or more channels, it is preferred that they are equispaced about the longitudinal axis of the conduit.

The fluid twisting function may simultaneously provide the heating or cooling function.

The yarn used in the process may be of any material capable of undergoing a heat setting operation, for example, a synthetic thermoplastic yarn. Especially suitable are polyamides which may be softened or plasticised under the effect of heat and water in liquid or vapour form. Polyester or copolyester yarns are also suitable. The process of the invention is useful in its application to yarns having a decitex from 800 to 8,000, especially carpet yarns. The yarn is bulked before being processed according to the invention by any bulking process, including stuffer-box, gear, false-twist or steam jet bulking. The bulked yarn may be wound up before processing or fed directly into a process according to the invention. Before being subjected to the modifying process the bulked yarn may be stretched to dephase its crimp.

Progress of the yarn through the conduit may be aided by external rollers or by including biassing jets, for forwarding the yarn in the conduit and the biassing jets may also serve to provide part of the modifying treatment according to the invention.

The means for supplying fluid to cause twisting of the yarn is one or more, preferably four discrete channels directed into the conduit tangentially to the yarn surface at an angle to the yarn axis. When that angle is 90°, no bias to forward or retard the yarn occurs. The angle may be other than 90°, its direction with respect to yarn travel direction depending upon whether forwarding or retarding of the yarn is required. The twisting jets may also act to heat and/or cool the yarn as part of the required thermal cycle. Two or more sets of twisting jets may be provided which may act in the same or opposite directions of twist.

At least two jet arrangements are provided to apply heating and cooling fluids to allow, successively, heating then cooling of the yarn. At least the final treatment must be cooling, though other stages may alternate more than one each of heating and cooling jets. The heating or cooling jets may also twist the yarn.

One or more jets may serve or be provided to intermingle the filaments of the yarn. Such jets may also serve as heating or cooling jets. Where hot fluid is supplied to any one of the sets of jets, it may be hot enough to cause some fusion of the yarn to give a harder texture to the treated yarn.

Figure 9:
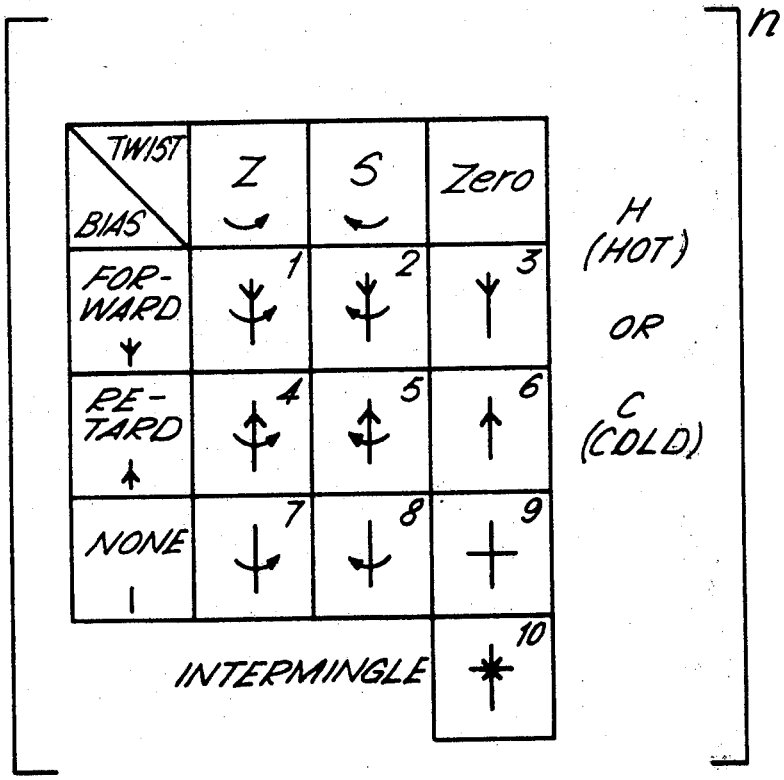

Combinations of treatments which may be applied are summarised in the matrix diagram of FIG. 9. Three forms of twist are possible, that is, S, Z or zero twist. The bias direction of the fluid treatment may be such as to forward, retard or have zero bias. In the case of zero bias, jet geometry may be particularly arranged to intermingle. However all jet configurations can be adapted to intermingle to a certain degree. Fluid applied at any given jet may be hot or cold. n represents the number of jets assembled into a given treatment apparatus. The number of possible combinations is reduced by the requirement that at least one jet must twist, at least one must be capable of heating and at least one final jet must be capable of cooling. Commonly the first jet heats and twists and the last jet at least cools. Some combinations are equivalent; in an otherwise identical combination S-followed by Z-twist produces similar results to Z-followed by S-twist unless the yarn feed already had some particular twist properties.

Treatment combinations are identified hereinafter by reference to the matrix square by number plus H or C for fluid temperature. Thus a heating, forwarding, S-twist jet is referred to as 2H and if followed by a cooling intermingly jet, the combination would be 2H/10C.

The fluid may be air, hot air or steam, as appropriate. When polyamide yarns are to be treated, steam is the preferred heating fluid. Some fusion occurs with temperatures above about 250° C.

Figure 2:
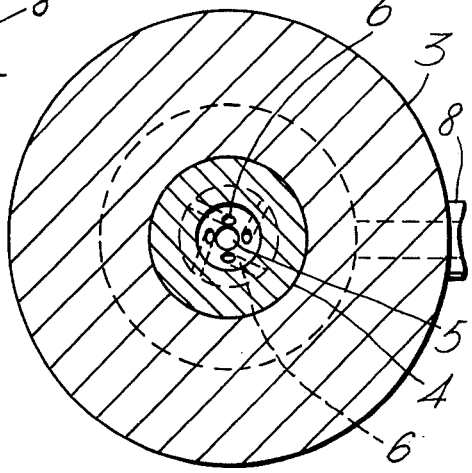
Figure 3:
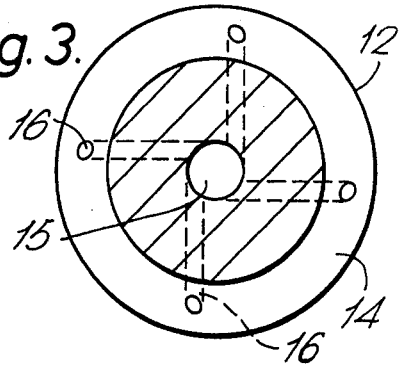
Figure 4:
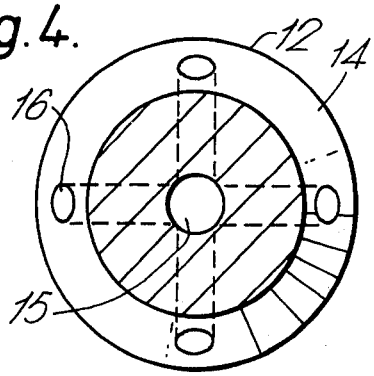
Figure 5:
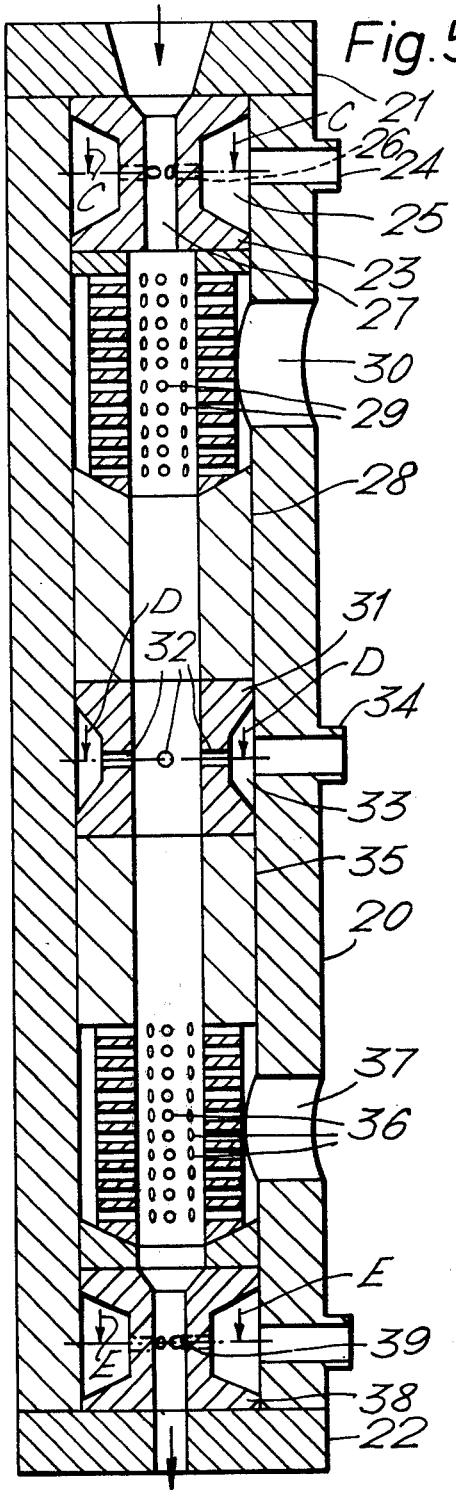
Figure 6:
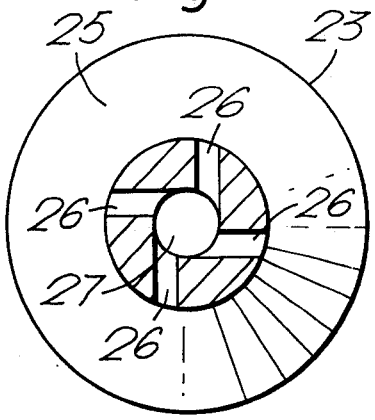
Figure 7:
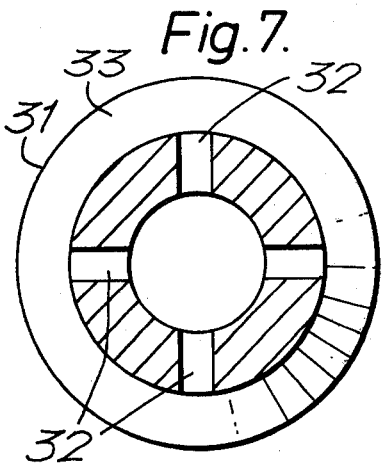
Figure 8:
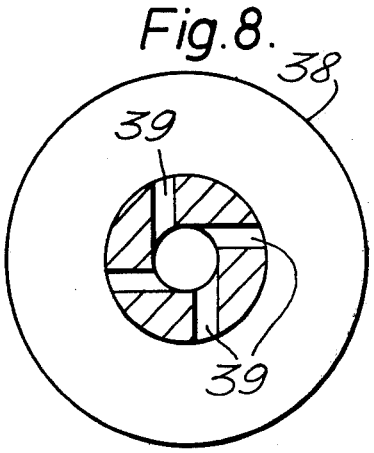

Two embodiments of the apparatus according to the invention will now be described by way of example with reference to FIGS. 1 to 8 of the accompanying drawings. FIG. 1 is a section through one form of modification apparatus which includes a first jet for forwarding, heating and twisting the yarn and a second jet for cooling or cooling and twisting the yarn. (Combinations 1H/5C or 1H/6C). FIG. 2 is a section in the plane A—A of FIG. 1 showing the construction of the first jet. FIG. 3 is a section in the plane B—B of FIG. 1 showing the construction of a second jet adapted to cool and twist the yarn. FIG. 4, an alternative to FIG. 3, is a section of another second jet adapted only to cool the yarn. FIG. 5 is a section through another form of yarn modification apparatus which includes three sets of jets. FIG. 6 is a section in the plane C—C of FIG. 5, showing a first set of jets arranged to S-twist the yarn. FIG. 7 is a section in the plane D—D of FIG. 5 showing a second set of jets. FIG. 8 is a section in the plane E—E of FIG. 6 showing a third set of jets arranged to Z-twist the yarn FIG. 9 is a matrix diagram of the of the combination of treatments which may be applied to the yarn.

In all the Figures, sealing gaskets, and retaining clamps and bolts are omitted for clarity.

With reference to FIG. 1, the apparatus has a conduit comprising yarn passageways 5 and 9, chamber 10 and yarn passageway 15. Yarn 1 enters the apparatus through an entry post in a cover plate 2. Between the cover plate 2 and apparatus body 3 there is retained a treatment jet 4 having a central conduit 5, and four tangential discrete channels 6 angled with respect to the conduit 5 so as to cause yarn forwarding and twisting (Z direction) in use. Channels 6 link the conduit 5 and a plenum chamber 7 which can be fed with a fluid via inlet 8. Conduit 5 continues as a narrow portion 9 which opens out into an exhaust chamber 10 provided with holes 11 which release fluid to the atmosphere. A second jet 12 is provided to supply fluid to retard and cool the yarn. Fluid enters through side port 13, plenum chamber 14 and passes to the lower central yarn conduit 15 via discrete channels 16. FIGS. 3 and 4 illustrate alternative jets 12 having tangential and radial channels 16 respectively, the former twisting (S-direction) and cooling and the latter merely cooling without twisting. Yarn leaves the apparatus via a port in the closure plate 17.

A second form of apparatus, this time having three treatment zones (8C/9H/7C), is shown in FIGS. 5–8. The body 20 of the apparatus comprises a tube into which the required series of jets and conduits are inserted. These are retained by cover plates 21 and 22. Fluid can be supplied to a first jet 23 via inlet tube 24 and plenum chamber 25. Discrete channels 26, perpendicular to conduit 27, are directed tangentially with respect to the yarn to cause S-twist in the yarn. Conduit 27 in Jet 23 connects to a wider conduit in an exhaust section 28 provided with exhaust holes 29 which vent through a port 30 in the body 20.

A second jet 31 is provided with four radial channels 32, plenum chamber 33 and inlet tube 34 to supply heating or cooling fluid as required. The next section is a further exhaust section 35 provided again with exhaust holes and a port 37. The final treatment is provided by the third jet 38 which is identical with jet 23, but with four channels 39 directed tangentially to cause Z-twist in the yarn.

The invention is further illustrated with reference to the following examples which describe the modification of a final 2650 dtex bulked nylon 66 yarn with 136 filaments. The yarn was bulked in a steam jet bulking apparatus as described in British Patent Specification No. 1,487,328. The yarn is pulled through the modification apparatus using a roll, aided where indicated by forwarding jets.

EXAMPLE 1

Bulked yarn was fed to an apparatus as described in FIG. 1 at a rate of 720 meters per minute and withdrawn at a rate of 1% less than the feed (ie 1% overfeed). Steam at 330° C. and 16 atmosphere pressure was fed to the first set of jets and cold air at 4 atmospheres was fed to the second set of jets, to give treatment combination 1H/5C.

The resulting yarn had slightly increased bulk, which leads to its having increased cover in a tufted carpet. The yarn had a kinked appearance which had a novel aesthetic quality. The yarn also had a twist and fusion more accurately controlled than those hitherto available.

EXAMPLE 2

A similar bulked yarn to that used in Example 1 was modified by an apparatus generally as described in FIG. 1 except that the sets of jets acted to twist the yarn in the opposite direction, combination 2H/4C. The first set of jets acted to twist the yarn using steam at 360° C. and at 16 atmospheres and the second set of jets acted to twist the yarn using cold air at 4 atmospheres. The yarn was fed to the apparatus at 720 meters per minute with an overfeed of 4%. The yarn had an increased bulk level, higher than that attainable hitherto, and was partly fused and highly twisted.

The yarn showed good tuft definition and the tufts did not tip over in cut-pile carpet.

EXAMPLE 3

A similar bulked yarn to that used in Example 1 was modified by an apparatus as described in FIG. 1 using treatment combination 1H/3C. The cold air from the second set of jets exerted no twisting action but merely cooled the yarn by directing air onto the yarn in a forwarding direction. Steam at 320° C. and 16 atmospheres was directed from the first set of jets to twist the yarn. The yarn was overfed by 1% at a feed rate of 900 meters per minute. The yarn had properties intermediate to those from Examples 1 and 2 and was highly bulked, intensely twisted and partly fused.

Comparative Example A

In a modification of Example 3, air from the second set of jets was stopped and the yarn was cooled by air outside the apparatus. The yarn had similar properties to those in Example 3 but control was less satisfactory.

EXAMPLE 4

A similar bulked yarn to that used in Example 1 was modified by an apparatus generally as described in FIG. 1. The first set of jets was fed with steam at 330° C. and 16 atmospheres without forwarding or twisting the yarn using cold air at 4 atmospheres, combination 9H/7C. The bulked yarn was fed to the apparatus at 720 m/min with no overfeed. The yarn had an increased bulk and a uniform twist level and showed good tuft definition in a loop pile carpet.

EXAMPLE 5

A similar bulked yarn to that used in Example 1 was modified by an apparatus as described in FIG. 5. Treatment combination 8C/9H/7C was used. No set of jets forwards the yarn. The first set of jets was fed with cold air at 4 atmospheres. The second set of jets heated the yarn with steam at 330° C. and 16 atmospheres. The third set of jets was also fed with cold air at 4 atmospheres.

We claim:

1. A continuous process for modifying the properties of a bulked yarn in which the bulked yarn is passed through a conduit and is subjected therein to (a) twisting by fluid and (b) at least one cycle of softening the yarn by heated fluid and cooling by fluid.

2. A process according to claim 1 wherein twisting the yarn by fluid comprises directing four streams of fluid tangentially onto the yarn.

3. A process according to claim 1 wherein the fluid to twist the yarn is hot and also serves to heat the yarn.

4. A process according to claim 1 wherein the fluid to twist the yarn also serves to forward the yarn.

5. A process according to claim 1 wherein the bulked yarn is stretched to dephase its crimp before it is passed into the conduit.

6. A process according to claim 1 wherein the filaments of the yarn are intermingled in the conduit by fluid.

7. A process according to claim 1 wherein the yarn is heated by the hot fluid to a temperature such that at least some of the filaments of the yarn fuse together.

8. A modified bulked yarn produced by a process according to claim 1.

9. An apparatus for modifying the properties of a bulked yarn comprising a conduit having at least two longitudinally-spaced jet arrangements (a) at least one jet arrangement having means to direct fluid into the conduit such as to exert a twisting action on a yarn in the conduit and (b) at least one jet arrangement having means to direct heated fluid into the conduit for heating the yarn and (c) at least one jet arrangement having means to direct fluid into the conduit to cool the yarn.

10. An apparatus according to claim 9 wherein the cross-sectional area of the conduit is non-uniform along its length.

11. An apparatus according to claim 9 wherein the conduit has one jet arrangement to twist and heat the yarn.

12. An apparatus according to claim 9 wherein the jet arrangement means for twisting comprises four discrete channels which are equispaced about the axis of the conduit and which enter the conduit eccentrically.

13. An apparatus according to claim 9 wherein the conduit has at least one jet whose geometry is arranged to intermingle the filaments of the yarn.

* * * * *